US006745476B2

(12) United States Patent
Korba, Jr.

(10) Patent No.: US 6,745,476 B2
(45) Date of Patent: Jun. 8, 2004

(54) CUTTING TOOL

(76) Inventor: William Korba, Jr., 9841 Glendale Rd., Demotte, IN (US) 46310

( * ) Notice: Subject to any disclaimer, the term of this patent is extended or adjusted under 35 U.S.C. 154(b) by 0 days.

(21) Appl. No.: 10/248,585

(22) Filed: Jan. 30, 2003

(65) Prior Publication Data

US 2003/0140505 A1 Jul. 31, 2003

Related U.S. Application Data

(60) Provisional application No. 60/353,937, filed on Jan. 30, 2002.

(51) Int. Cl.[7] ..... B26B 29/00; B26B 3/00

(52) U.S. Cl. ..... 30/292; 30/243; 30/294; 30/299

(58) Field of Search ..... 30/292, 293, 294, 30/299, 305, 307; D8/14, 98, 99

(56) References Cited

U.S. PATENT DOCUMENTS

| | | | | | |
|---|---|---|---|---|---|
| 421,717 | A | * | 2/1890 | Hunt | 30/294 |
| 1,031,578 | A | * | 7/1912 | Palis | 30/292 |
| 1,125,458 | A | * | 1/1915 | Burns | 30/292 |
| 1,586,646 | A | * | 6/1926 | Blevin et al. | 30/293 |
| 1,705,882 | A | * | 3/1929 | Springer | 30/293 |
| 2,073,855 | A | * | 3/1937 | Steinmetz | 30/294 |
| 2,282,062 | A | * | 5/1942 | Jewett | 30/294 |
| 2,291,294 | A | * | 7/1942 | Holste | 30/294 |
| 2,649,656 | A | * | 8/1953 | Hedrick | 30/294 |
| 2,679,098 | A | * | 5/1954 | Deicken | 30/293 |
| 2,680,906 | A | * | 6/1954 | Mayer | 30/293 |
| 3,153,853 | A | * | 10/1964 | Lipton | 30/294 |
| D203,268 | S | * | 12/1965 | Swann, Jr. | D8/98 |
| 3,383,768 | A | * | 5/1968 | Hamilton | 30/294 |
| 3,644,993 | A | * | 2/1972 | Chupp | 30/294 |
| 3,791,014 | A | * | 2/1974 | Perna | 30/294 |
| D255,981 | S | * | 7/1980 | Carbo | D8/98 |
| 4,495,697 | A | * | 1/1985 | Ruff | 30/294 |
| 4,667,409 | A | * | 5/1987 | D'Amato | 30/294 |
| 4,711,031 | A | * | 12/1987 | Annello | 30/294 |
| D308,811 | S | * | 6/1990 | Hochfeld et al. | D8/98 |
| 5,127,161 | A | * | 7/1992 | Ikeda | 30/294 |
| 5,555,624 | A | * | 9/1996 | McCracken | 30/294 |
| 5,561,903 | A | * | 10/1996 | Bourbeau | 30/294 |
| D379,421 | S | * | 5/1997 | Friedman | D8/98 |
| 5,666,731 | A | * | 9/1997 | Rungren | 30/294 |
| 5,720,104 | A | * | 2/1998 | Decker | 30/293 |
| 5,791,048 | A | * | 8/1998 | Bodnar et al. | 30/294 |
| 5,815,929 | A | * | 10/1998 | Ojea | 30/294 |
| 5,815,930 | A | * | 10/1998 | Kojima | 30/294 |
| 5,992,286 | A | * | 11/1999 | Boole | 30/294 |
| D419,417 | S | * | 1/2000 | Kane | D8/98 |
| D423,318 | S | * | 4/2000 | Lacy | D8/98 |
| D435,775 | S | * | 1/2001 | Rothschild et al. | D8/98 |
| 6,378,216 | B1 | * | 4/2002 | Meyer | 30/293 |
| 6,490,794 | B1 | * | 12/2002 | Luttrell | 30/299 |
| D477,520 | S | * | 7/2003 | McCracken | D8/98 |
| 6,615,495 | B1 | * | 9/2003 | Evens et al. | 30/294 |
| 6,625,889 | B2 | * | 9/2003 | Belsaas | 30/294 |

* cited by examiner

*Primary Examiner*—Allan N. Shoap
(74) *Attorney, Agent, or Firm*—Gary M. Hartman; Domenica N. S. Hartman; Hartman & Hartman

(57) ABSTRACT

A cutting tool (10) adapted to produce chamfers along the edges of drywall panels. The tool (10,110,210) comprises a housing having a channel (18) defined by a base wall (13) and substantially parallel first and second sidewalls (15,17) that are substantially perpendicular to the base wall (13). A primary cutting blade (30) extends from the first sidewall (15) at an angle across the channel (18) toward the second sidewall (17). The primary blade (30) is configured to cut through an edge of a panel placed in the channel (18) as the cutting tool (10,110,210) is caused to move along the edge of the panel, thereby creating a chamfered edge on the panel. A second cutting blade (32) also extends from the first sidewall (15) and is positioned adjacent the primary blade (30) to create a perforation in the edge of the panel prior to the panel encountering the primary blade (30).

20 Claims, 3 Drawing Sheets

CUTTING TOOL

CROSS REFERENCE TO RELATED APPLICATIONS

This application claims the benefit of U.S. Provisional Application No. 60/353,937, filed Jan. 30, 2002.

BACKGROUND OF INVENTION

1. Field of the Invention

The present invention generally relates to cutting tools. More particularly, this invention relates to a cutting tool adapted for cutting the edge of a drywall panel, so as to produce a chamfer on the panel.

2. Description of the Related Art

A chamfer is often cut in each of a pair of drywall panels that meet at an interior or exterior corner, so that the joint formed by the panels is more uniform. Drywall chamfers are typically cut with a handheld utility knife. As a result, a consistent chamfer is very labor intensive and difficult to achieve.

SUMMARY OF INVENTION

The present invention provides a cutting tool adapted to readily and repeatably produce chamfers along the edges of drywall panels. The tool comprises a housing having a channel defined by a base wall and substantially parallel first and second sidewalls that are substantially perpendicular to the base wall. A primary cutting blade extends from the first sidewall at an angle across the channel toward the second sidewall. The primary cutting blade is configured to cut through an edge of a panel placed in the channel as the cutting tool is caused to move along the edge of the panel, thereby creating a chamfered edge on the panel at an angle. According to a preferred aspect of the invention, the primary blade is positively positioned in the channel so as to be able to repeatably produce chamfers on the edges of panels drawn through the channel. The tool further comprises a second cutting blade extending from the first sidewall. The second cutting blade is positioned adjacent the primary blade and configured to create a perforation in the edge of the panel prior to the panel encountering the primary cutting blade as the cutting tool is caused to move along the edge of the panel. The second blade greatly facilitates cutting of the panel with the primary blade and reduces tearing of the outer paper layers on the panel.

Other objects and advantages of this invention will be better appreciated from the following detailed description.

BRIEF DESCRIPTION OF DRAWINGS

FIGS. 1 and 2 show the tool without cutting blades, and FIG. 3 shows the tool with the location of the cutting blades indicated in phantom.

DETAILED DESCRIPTION

Figure 1:
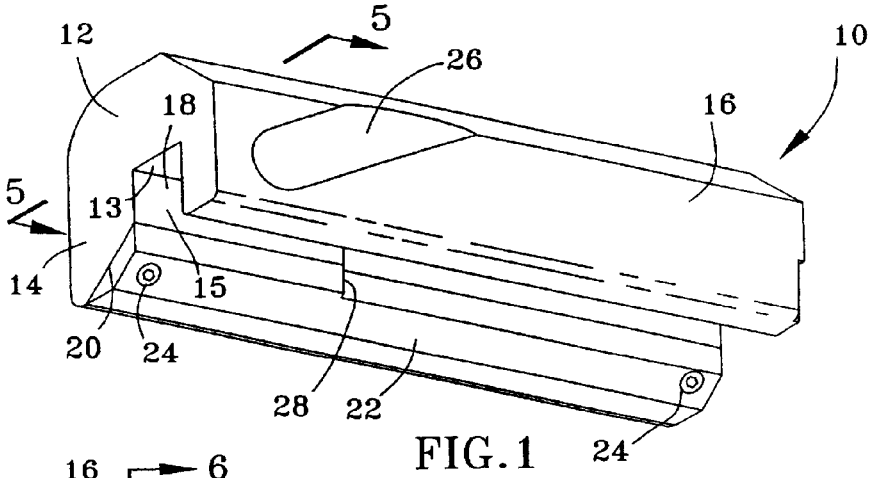
FIGS. 1, 2 and 3 are perspective views of a cutting tool in accordance with a first embodiment of the invention.
Figure 2:
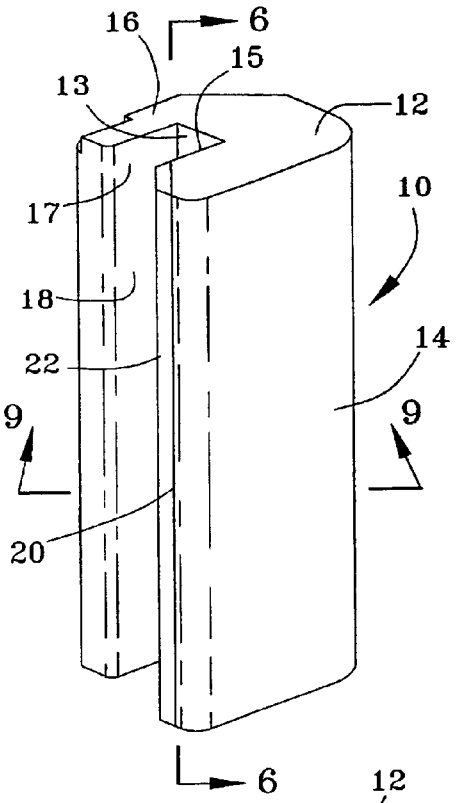
Figure 3:
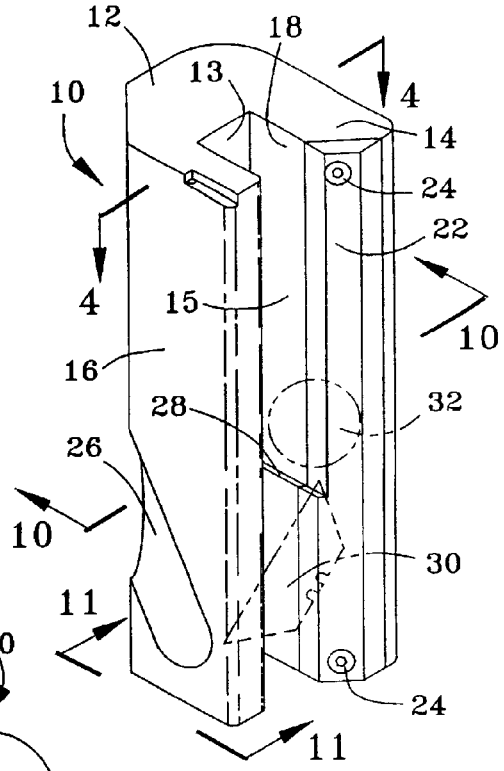

FIGS. 1, 2 and 3 show a cutting tool 10 of this invention as having a generally U-shaped cross-section that defines a base 12, a first leg 14, a second leg 16, and a channel 18. In FIGS. 1 and 3, a recess 26 is visible in the second leg 16 for receiving the user's thumb, facilitating a user's grip on the tool 10. The first leg 14 is shown as extending farther from the base 12 than the second leg 16. The channel 18 is delimited by a base wall 13 defined by the base 12 and sidewalls 15 and 17 defined by the legs 14 and 16, respectively. As shown, the sidewalls 15 and 17 are substantially parallel to each other, and substantially perpendicular to the base wall 13. The channel 18 is shaped and sized to accommodate drywall panels (not shown) having thicknesses of ½ inch to ⅝ inch, though it is foreseeable that the tool 10 could be sized for panels of greater and lesser thicknesses.

Figure 5:
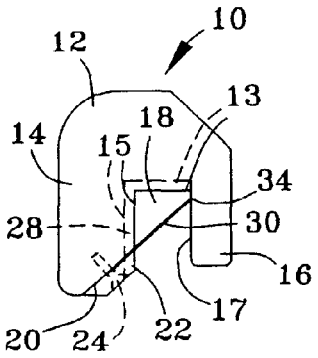
FIG. 5 is an end view of the cutting tool of FIGS. 1 through 4, taken from the opposite end of that shown in FIG. 4 and showing cutting blades installed.
Figure 6:
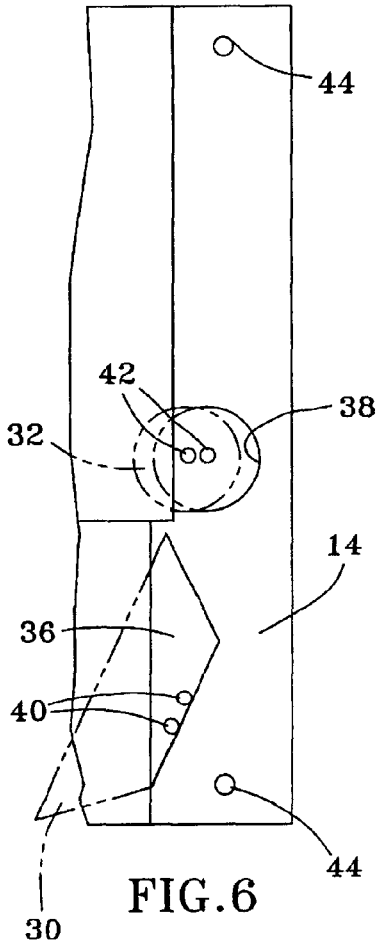
FIG. 6 is a plan view of an angled surface of FIG. 5 against which the blades are clamped with a cover plate (not shown).
Figure 9:
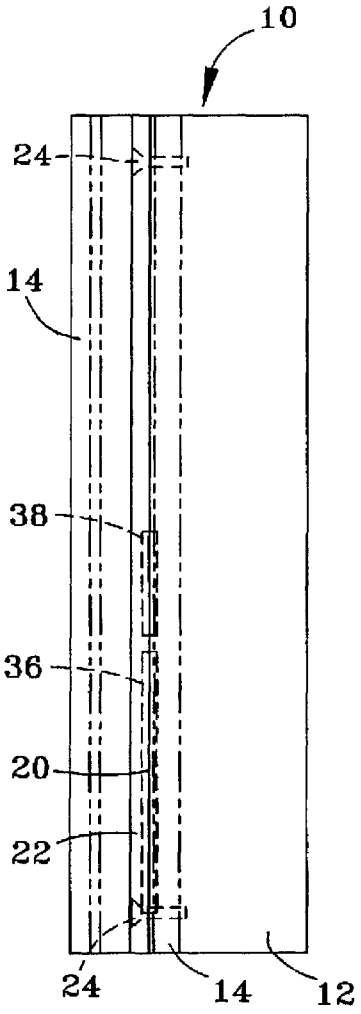
FIG. 9 is a view of the tool taken in a direction parallel to the surface shown in FIG. 6.
Figure 10:
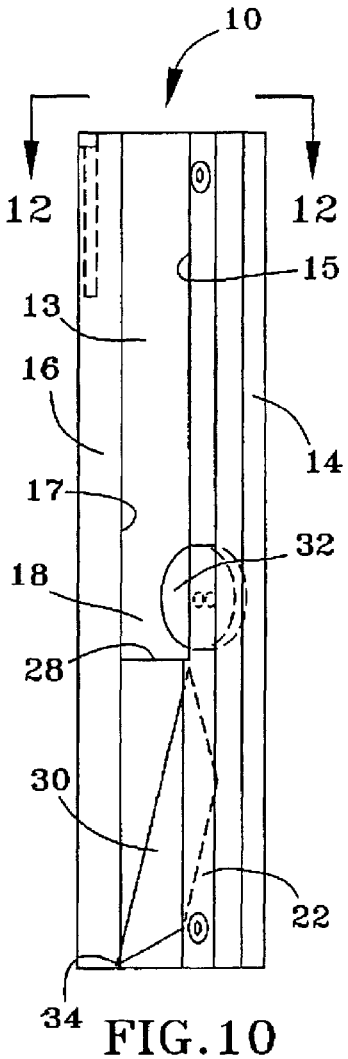
FIG. 10 is a bottom view of the tool shown in FIG. 5.

A cover plate 22 is secured to an angled surface 20 of the first leg 14 that is not parallel to the base wall 13 or the sidewalls 15 and 17 of the channel 18. The cover plate 22 is used to secure a pair of cutting blades 30 and 32 to the tool 10, as shown in phantom in FIG. 3. FIGS. 5 and 10 show the blades 30 and 32 installed in the tool 10. FIG. 6 (which is a view of only the angled surface 20 of the first leg 14 and taken normal to the surface 20) and FIG. 9 (which is a side view in a direction parallel to the surface 20) show a pair of recesses 36 and 38 in the surface 20 of the first leg 14 for receiving roughly half of the each blade 30 and 32, respectively. The larger blade 30 is termed the primary blade, in that it produces the chamfer cut on a drywall panel. FIG. 5 shows the primary blade 30 set to cut a forty-five degree chamfer, though other angles are foreseeable. The primary blade 30 is depicted as a conventional utility blade, though other types of blades could foreseeably be used. FIGS. 5 and 10 also show a notch 34 in the second leg 16 of the tool 10 for receiving the tip of the primary blade 30. The notch 34 permits the primary blade 30 to extend completely across the channel 18. The second blade 32 is termed the perforation blade, in that it cuts through the facing outer paper layer conventionally present on a drywall panel. The perforation blade 32 is oriented at the same angle across the channel 18 as the primary blade 30, and greatly facilitates the cutting operation performed by the primary blade 30. The perforation blade 32 is shown as being circular in shape, though other types of blades are foreseeable.

Figure 4:
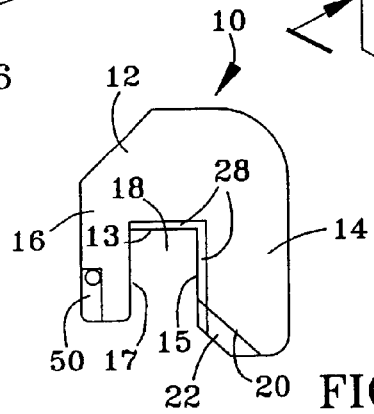
FIG. 4 is an end view of the cutting tool of FIGS. 1 through 3.

In FIG. 4, a cutout 28 is shown as being present in the base wall 13 and the sidewall 15 of the channel 18, such that the second blade 32 is located in a portion of the channel 18 that is wider in a direction normal to the sidewalls 15 and 17 and deeper in a direction normal to the base wall 13 than the portion of the channel 18 in which the primary blade 30 is located. When using the tool 10, the cutout 28 follows the blades 30 and 32 to accommodate the portion of the drywall panel removed by the primary blade 30. Otherwise, removed drywall tends to clog the channel 18 if the cutout 28 is not present.

Figure 7:
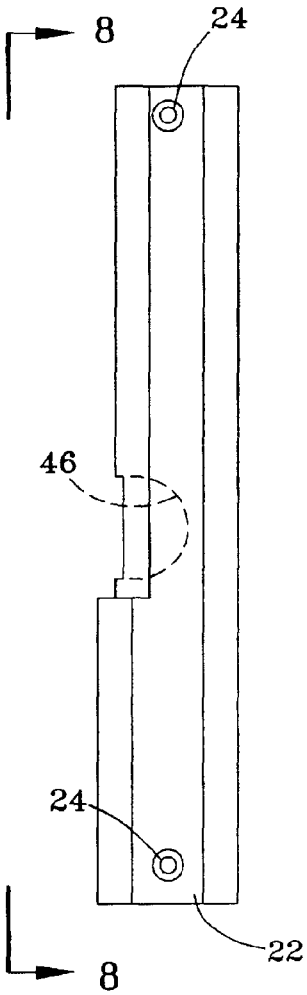
FIGS. 7 and 8 are plan and side views, respectively, of a cover plate for the cutting tool of FIGS. 1 through 5.
Figure 8:
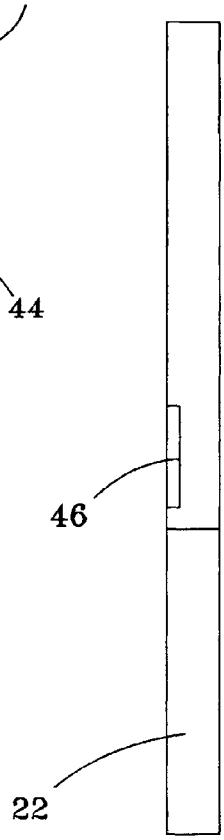
Figure 11:
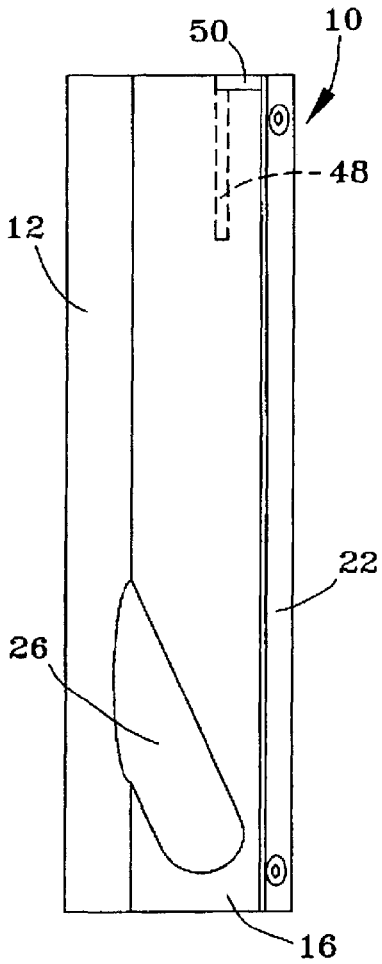
FIG. 11 is a right-hand view of the tool shown in FIG. 5.

The relative placement of the blades 30 and 32 in their respective recesses 36 and 38 and relative to the channel 18 are most readily apparent from FIGS. 5 and 10. The primary and secondary blades 30 and 32 are represented in FIGS. 5 and 10 as being clamped with the cover plate 22. FIG. 6 further shows two pins 40 present in the recess 36 for engaging holes present on a conventional utility blade opposite its cutting edge. Two threaded holes 42 are provided in the recess 38 to provide two positions for the perforation blade 32, which facilitate cutting of drywall panels of different thicknesses. Two threaded holes 44 are provided for receiving screws 24 used to secure the cover plate 22 to the angled surface 20. The cover plate 22 is separately shown in a plan view and side view in FIGS. 7 and 8, respectively. As shown, the cover plate 22 preferably includes a recess 46 that, with the recess 38 in the angled surface 20, provides sufficient clearance to permit the perforation blade 32 to rotate. FIGS. 4 and 11 show the leg 14 as having a bore 48 and recess 50 sized to receive an alien wrench (not shown) for use in removing the screws 24 used to secure the cover plate 22.

Figure 12:
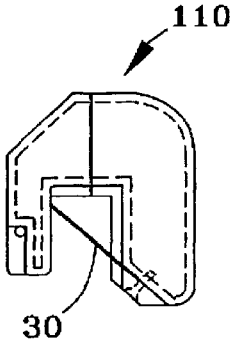
FIGS. 12 and 13 are end views of cutting tools in accordance with second and third embodiments of the invention.

The cutting tool 10 shown in FIGS. 1 through 11 is portrayed as being machined from solid stock, such as aluminum. The embodiment of FIG. 12 represents a cutting tool 110 in which the base 12 and legs 14 and 16 are formed from two molded sections secured together, such that the tool 110 is hollow. Otherwise, the tool 110 is substantially identical to that of FIGS. 1 through 11.

Figure 13:
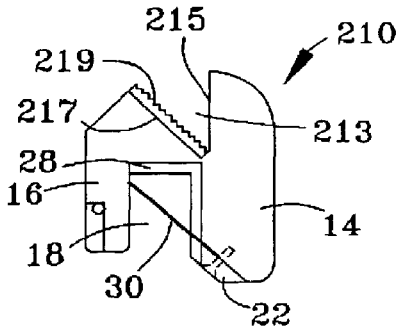

A cutting tool 210 in accordance with a third embodiment of the invention is represented in FIG. 13. The cutting tool 210 is essentially identical to the tool of FIGS. 1 through 11, except for the addition of a V-shaped slot 213 defined in the base 12 opposite the channel 18. As evident from FIG. 13, the slot 213 is defined by two walls 215 and 217, the second wall 217 being disposed at roughly forty-five degrees to the first wall 215, and therefore approximately equal to the angle at which the primary blade 30 extends across the channel 18. As such, the wall 217 is disposed at an angle corresponding to the angled cut made through the edge of a drywall panel with the primary blade 20. A rasp 219 is defined on the surface of the wall 217. The rasp 219 may have any suitable configuration, such as straight, sinusoidal or serrated raised features that are continuous across the surface of the wall 217, i.e., from the outer edge of the wall 217 to the intersection of the walls 215 and 217. Alternatively, the rasp 219 may comprise individual raised features (e.g., square protrusions). By passing the edge of a drywall panel through the slot 213, the rasp 219 enables the user to clean up or remove additional material from the chamfered cut made with the primary blade 30.

While the invention has been described in terms of specific embodiments, it is apparent that other forms could be adopted by one skilled in the art. In addition, it is foreseeable that various materials could be used in the construction of the tools 10, 110 and 210, and the tools 10, 110 and 210 could differ in appearance and construction from the embodiments shown in the Figures. Therefore, the scope of the invention is to be limited only by the following claims.

What is claimed is:

1. A cutting tool comprising:

a housing having a channel defined by a base wall and substantially parallel first and second sidewalls that are substantially perpendicular to the base wall;

a primary cutting blade extending from the first sidewall across the channel and toward the second sidewall, the primary cutting blade being at an acute angle to the first sidewall and inclined toward the base wall, the primary cutting blade being configured to cooperate with the second sidewall to cut entirely through an edge of a panel placed in the channel as the cutting tool is caused to move along the edge of the panel, thereby creating a chamfered edge on the panel; and a second cutting blade extending from the first sidewall, the second cutting blade being positioned adjacent the primary blade and configured to create a perforation in the edge of the panel prior to the panel encountering the primary cutting blade as the cutting tool is caused to move along the edge of the panel.

2. A cutting tool according to claim 1, wherein the second cutting blade is rotatably mounted to the housing.

3. A cutting tool according to claim 1, wherein the second cutting blade is located in a portion of the channel that is wider in a direction normal to the sidewalls and deeper in a direction normal to the base wall than a portion of the channel in which the primary cutting blade is located.

4. A cutting tool according to claim 1, wherein the housing has a substantially U-shaped cross-section.

5. A cutting tool according to claim 1, wherein the first sidewall extends a greater distance from the base than does the second sidewall.

6. A cutting tool according to claim 1, further comprising a V-shaped slot defined in the base opposite the channel and rasp means defined on a surface of the V-shaped slot.

7. A cutting tool according to claim 1, wherein the primary cutting blade is inclined at an angle of about forty-five degrees to the base wall.

8. A cutting tool according to claim 1, wherein the primary and second cutting blades are secured to a surface of the housing that is not parallel to the base wall or the sidewalls of the channel.

9. A cutting tool according to claim 8, wherein the second cutting blade is received in a recess defined in the surface of the first leg.

10. A cutting tool according to claim 8, wherein the second cutting blade is secured to the surface of the housing so as to rotate about an axis normal to the surface.

11. A cutting tool according to claim 8, wherein the primary cutting blade is received in a recess defined in the surface of the housing.

12. A cutting tool according to claim 11, wherein the primary cutting blade is also received in a second recess defined in the second sidewall.

13. A cutting tool for producing a chamfer along an edge of a drywall panel, the cutting tool comprising:

a housing having a base and first and second legs extending from the base, the base and first and second legs defining a channel having a base wall and substantially parallel sidewalls that are substantially perpendicular to the base wall, the first leg having a surface that is not parallel to the base wall or to the sidewalls of the channel;

a primary cutting blade mounted to the surface of the first leg and extending across the channel into the second leg at an angle of about forty-five degrees to the base wall of the channel, the primary cutting blade being configured to cooperate with the second sidewall to cut entirely through an edge of a panel placed in the channel as the cutting tool is caused to move along the edge of the panel, thereby creating an approximately forty-five-degree chamfered edge on the panel; and a second cutting blade rotatably mounted to the surface of the first leg, the second cutting blade being positioned adjacent the primary blade and configured to create a perforation in the edge of the panel prior to the panel encountering the primary cutting blade as the cutting tool is caused to move along the edge of the panel.

14. A cutting tool according to claim 13, wherein the second cutting blade is received in a recess defined in the surface of the first leg.

15. A cutting tool according to claim 13, wherein the second cutting blade is located in a portion of the channel that is wider in a direction normal to the sidewalls and deeper in a direction normal to the base wall than a portion of the channel in which the primary cutting blade is located.

16. A cutting tool according to claim 13, wherein the housing has a substantially U-shaped cross-section.

17. A cutting tool according to claim 13, further comprising:

a V-shaped slot defined in the base opposite the channel, the V-shaped slot having a surface disposed at an angle to the base that is approximately equal to the angle at which the primary cutting blade extends across the channel; and rasp means defined on the surface of the V-shaped slot.

18. A cutting tool according to claim 13, wherein the first leg extends a greater distance from the base than does the second leg.

19. A cutting tool according to claim 13, wherein the primary cutting blade is received in a recess defined in the surface of the first leg.

20. A cutting tool according to claim 19, wherein the primary cutting blade is also received in a second recess defined in the second leg.

* * * * *